US009989910B2

(12) United States Patent
Fujita

(10) Patent No.: US 9,989,910 B2
(45) Date of Patent: Jun. 5, 2018

(54) IMAGE FORMING APPARATUS

(71) Applicant: CANON KABUSHIKI KAISHA, Tokyo (JP)

(72) Inventor: Keisuke Fujita, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 14/476,109

(22) Filed: Sep. 3, 2014

(65) Prior Publication Data

US 2015/0063890 A1 Mar. 5, 2015

(30) Foreign Application Priority Data

Sep. 5, 2013 (JP) ..... 2013-184049

(51) Int. Cl.
*G03G 15/00* (2006.01)

(52) U.S. Cl.
CPC . *G03G 15/6552* (2013.01); *B65H 2404/1451* (2013.01); *G03G 15/6573* (2013.01); *G03G 2215/00531* (2013.01); *G03G 2215/00708* (2013.01); *G03G 2221/0089* (2013.01)

(58) Field of Classification Search
CPC ... B65H 2404/1451; G03G 2221/0089; G03G 15/6573; G03G 2215/00531; G03G 2215/00708
See application file for complete search history.

(56) References Cited

U.S. PATENT DOCUMENTS

| | | | | |
|---|---|---|---|---|
| 6,330,419 | B1 * | 12/2001 | Sano et al. | 399/322 |
| 2005/0265762 | A1 * | 12/2005 | Ahn | G03G 15/6552 399/405 |
| 2009/0214279 | A1 * | 8/2009 | Ito | 399/405 |
| 2010/0025928 | A1 * | 2/2010 | Yamamoto | B65H 29/14 271/302 |
| 2010/0296831 | A1 * | 11/2010 | Sakai | 399/85 |

FOREIGN PATENT DOCUMENTS

| | | | |
|---|---|---|---|
| JP | H11-071037 | A | 3/1999 |
| JP | 11311893 | A * | 11/1999 |
| JP | 2001-142328 | A | 5/2001 |
| JP | 2005-331863 | A | 12/2005 |
| JP | 2009-202965 | A | 9/2009 |
| JP | 2010-247981 | A | 11/2010 |
| JP | 2010-269865 | A | 12/2010 |
| JP | 2012-101941 | A | 5/2012 |
| JP | 2013-107725 | A | 6/2013 |

* cited by examiner

*Primary Examiner* — R. A. Smith
*Assistant Examiner* — John M Royston
(74) *Attorney, Agent, or Firm* — Canon U.S.A., Inc. IP Division

(57) ABSTRACT

The present invention is directed to downsize the main body and achieve a good image quality at a low cost. A rotation shaft of a first discharge roller is tilted with respect to that of a second discharge roller. The center of oscillation C of a first discharge roller holding member is provided more upstream in the direction in which a sheet is discharged than a straight line made by the rotation center of the first discharge roller and the rotation center of the second discharge roller.

8 Claims, 8 Drawing Sheets

IMAGE FORMING APPARATUS

BACKGROUND OF THE INVENTION

Field of the Invention

The present invention relates to an image forming apparatus.

Description of the Related Art

There has been an image forming apparatus such as a copying machine and a printer in which a toner image (an image) formed by an image forming unit is fixed on a sheet and then the sheet is discharged by a discharge roller pair formed of two discharge rollers. There has been another image forming apparatus in which a sheet, on which a toner image is fixed, is conveyed again to an image forming unit and an image is formed on the other side of the sheet.

In such an image forming apparatus, when an image is formed on the sheet, an electrostatic latent image is first formed on the surface of a photosensitive drum provided on the image forming unit and developed by a toner to form a toner image on the surface of the photosensitive drum. Then, the toner image is transferred onto the sheet and then the sheet is heated and pressed in a fixing unit to fix the toner image onto the sheet. A discharge roller pair is rotated forward to discharge the sheet, on which the toner image is fixed, to a sheet stacking unit. When images are formed on both sides of a sheet, the discharge roller pair is reversely rotated to convey the sheet to a re-conveyance path and again to the image forming apparatus.

In recent years, a processing speed of an image forming apparatus has been increased and the size thereof has been reduced. For this reason, a distance between a fixing unit and a discharge roller pair is decreased and a sheet which is heated and pressed by the fixing unit to be extremely high in temperature is nipped by the discharge roller pair with the sheet remained at high temperature. This may cause the toner high in temperature to stick to the surface of the discharge roller. The toner sticking thereto further sticks to the sheet to be discharged next as a roller trace, which may degrade the image quality of the next sheet.

Conventionally, a material such as fluororesin high in resistance to toner fusion has been employed as a material of a discharge roller which is brought into pressure contact with the surface of the toner image to prevent a roller trace from occurring. If the processing speed of the image forming apparatus is further increased and the size thereof is further reduced, the roller trace cannot be prevented from occurring only by increasing resistance to toner fusion on the surface of the discharge roller. There is a method for preventing the roller trace from occurring in which a plurality of discharge rollers brought into pressure contact with a discharge roller is symmetrically tilted with respect to the direction in which the sheet is conveyed with the center of the sheet in the width direction thereof orthogonal to the sheet conveyance direction as a center. The discharge rollers are thus tilted to enable the rear end portion of the sheet to shave off the toner sticking to the surface of the discharge roller even if the toner at the leading edge of the sheet sticks to the surface of the discharge roller.

However, in a case where the discharge rollers are thus tilted, a problem is caused in which the end portion of the discharge roller is brought into close contact with a sheet to produce a linear trace on the sheet. The problem of the linear trace can be improved by decreasing the nip pressure of the discharge roller pair. However, it is difficult to decrease the nip pressure of the discharge roller pair because the re-conveyance path and a shutter mechanism for correcting the registration of the sheet are subjected to resistance when images are formed on both sides of a sheet.

Japanese Patent Application Laid-Open No. 2001-142328 discusses a technique in which the nip of a sub-conveyance member at the rear of the fixing unit is made attachable and detachable using an actuator such as a solenoid to solve both problems of the linear trace and required conveyance force to the re-conveyance path. However, with the structure discussed in Japanese Patent Application Laid-Open No. 2001-142328, the actuator is required, which remains a problem that the image forming apparatus is increased in size and the cost is increased because the number of components is increased.

SUMMARY OF THE INVENTION

According to an aspect of the present invention, an image forming apparatus includes, an image forming unit configured to form an image on a sheet, a driving rotation member configured to rotate forward to discharge the sheet, on which the image forming unit has formed an image, outside a main body of the image forming apparatus, and reversely rotate to convey again the sheet to the image forming unit, a driven rotation member arranged opposing the driving rotation member, and configured to be driven to rotate by the driving rotation member, a driven rotation shaft arranged tilting with respect to a rotation shaft of the driving rotation member and configured to support the driven rotation member, a holding member configured to oscillatably hold the driven rotation member, and an urging member configured to urge the holding member to urge the driven rotation member in the direction of the driving rotation member, in which a fulcrum of oscillation of the holding member is provided on a upstream side of a straight line made by the center of the driving rotation member and the center of the driven rotation member in the direction in which the sheet is discharged.

According to another aspect of the present invention, an image forming apparatus includes, an image forming unit configured to form an image on a sheet, a driving rotation member configured to rotate forward to discharge the sheet, on which the image forming unit has formed an image, outside a main body of the image forming apparatus and reversely rotated to convey again the sheet to the image forming unit, a driven rotation member arranged opposing the driving rotation member and configured to be driven to rotate by the driving rotation member, a driven rotation shaft arranged tilting with respect to a rotation shaft of the driving rotation member and configured to support the driven rotation member, and an urging portion configured to urge the driven rotation member in the direction of the driving rotation member, in which the driven rotation shaft has a portion different in diameter in the direction of the driven rotation shaft, and in which the driven rotation member is provided to be movable in the direction of the driven rotation shaft.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

Figure 1:
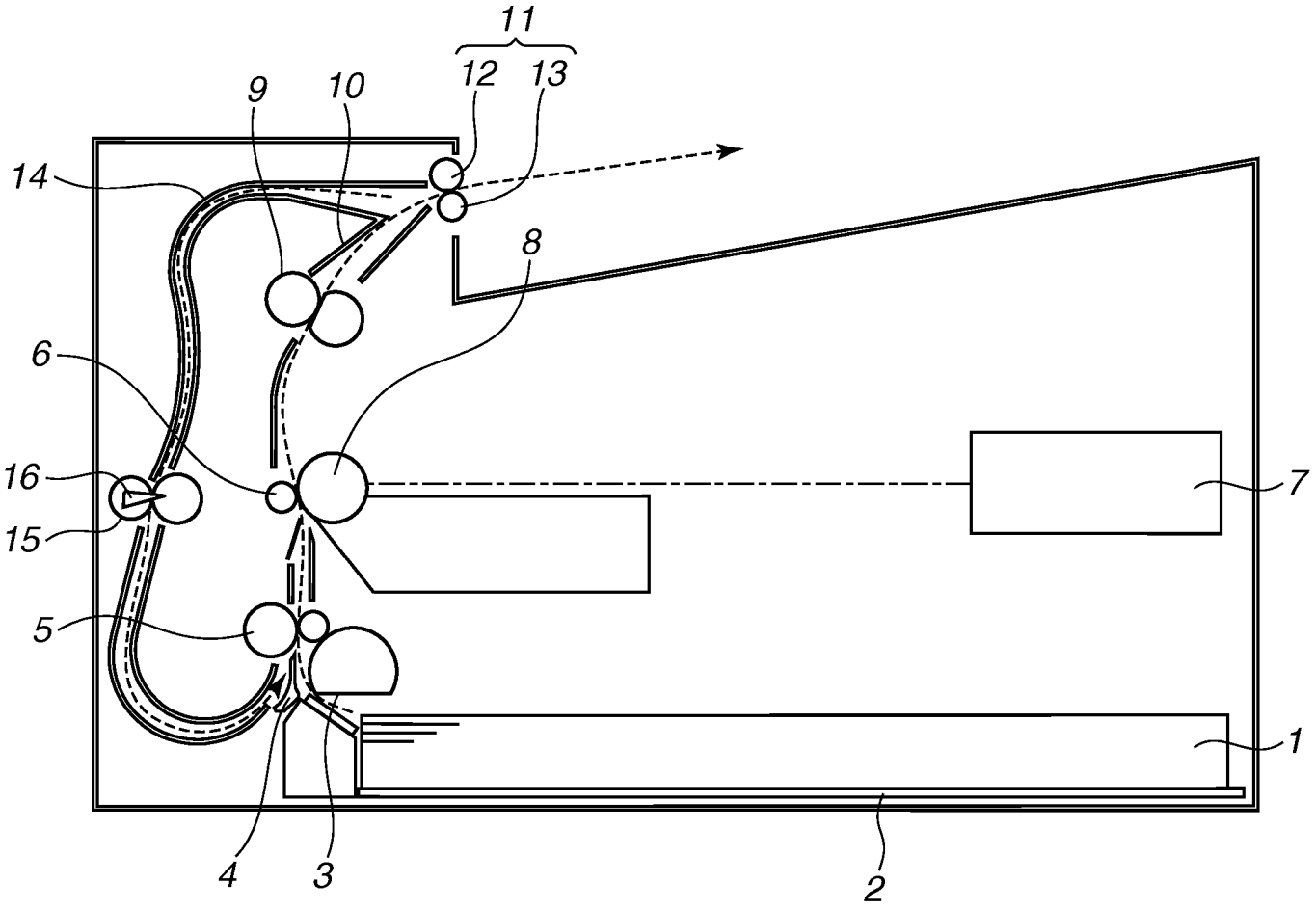
FIG. 1 is a cross section illustrating a schematic configuration of an image forming apparatus according to a first exemplary embodiment.

A first exemplary embodiment of the present invention is described in detail below with reference to the accompanied drawings. FIG. 1 is a cross section illustrating a schematic configuration of a laser printer which is an example of an image forming apparatus according to the present exemplary embodiment of the present invention.

A sheet material 1 is stacked on a sheet material stacking member 2. The sheet material 1 is separated by a sheet feeding unit 3 sheet by sheet and conveyed to a conveyance unit 5 along a conveyance guide 4. The sheet material 1 is conveyed by the conveyance unit 5 to a transfer unit 6. A toner image formed by a laser unit 7 and the transfer unit 6 on a photosensitive drum 8 is transferred onto the sheet material 1. The sheet material 1 onto which the toner image is transferred is subjected to heat and pressure by a fixing unit 9, and the toner image is fixed to the sheet material 1. In the first exemplary embodiment, an image forming unit for forming an image on the sheet by the transfer unit 6 and the fixing unit 9 is configured.

Thereafter, the sheet material 1 is conveyed to a discharge unit 11 along a discharge guide 10. The discharge unit 11 includes a discharge roller (driving rotation member) 12 and a discharge roller (driven rotation member) 13. The discharge roller 12 receives a driving force from a driving source (not illustrated) to enable normal and reverse rotation. The discharge roller 13 is arranged at a position opposed to the discharge roller 12 and driven by the discharge roller 12.

The discharge roller 12 is rotated forward to discharge the sheet material 1 outside the main body of the image forming apparatus. In a case where images are formed on both sides of the sheet material 1, a part of the sheet material 1 is discharged outside the main body and when the rear edge of the sheet material 1 has passed though the discharge guide 10, the discharge roller 12 is reversely rotated. This causes the sheet material 1 on one side of which an image is formed to enter a re-conveyance guide (the re-conveyance path) 14 and the sheet material 1 is conveyed to a re-conveyance roller pair (re-conveyance unit) 15. A registration shutter (a skew correction portion) 16 provided near the re-conveyance roller pair 15 corrects the skew (tilt) of the sheet material 1. The sheet material 1 is again conveyed by the re-conveyance roller pair 15 to the conveyance unit 5, an image is transferred and fixed onto the other side thereof, and the sheet material 1 is discharged outside the main body from the discharge unit 11.

When the sheet material 1 is discharged outside the main body (when the discharge roller 12 is rotated forward), a distance over which the sheet material 1 is discharged only by the discharge unit 11 is only between the fixing unit 9 and the discharge unit 11 after the rear edge of the sheet material 1 passes though the fixing unit 9. Since the discharge guide 10 is linear, a conveyance resistance to which the sheet material 1 is subjected at this moment is small. For this reason, the nip pressure of the discharge unit 11 required in discharging the sheet material 1 outside the main body is small. The nip pressure of the discharge unit 11 refers to force in which the discharge roller 12 and the discharge roller 13 nip the sheet.

When images are formed on both sides of the sheet material 1 (when the discharge roller 12 is reversely rotated), a distance over which the sheet material 1 is conveyed only by the discharge unit 11 is between the discharge unit 11 and the re-conveyance unit 15. Thus, the distance over which the sheet material 1 is conveyed only by the discharge unit 11 is increased. The re-conveyance guide 14 has a curvature to downsize the main body, and a conveyance resistance to which the sheet material 1 is subjected at the re-conveyance guide 14 is larger than that at the discharge guide 10. Furthermore, a conveyance force for pushing and opening the registration shutter 16 which corrects a tilt due to the conveyance of the sheet material 1 is required. The nip pressure of the discharge unit 11 required for forming images on both sides of the sheet material 1 is larger than that in a case where the sheet material 1 is discharged outside the main body.

Figure 2:
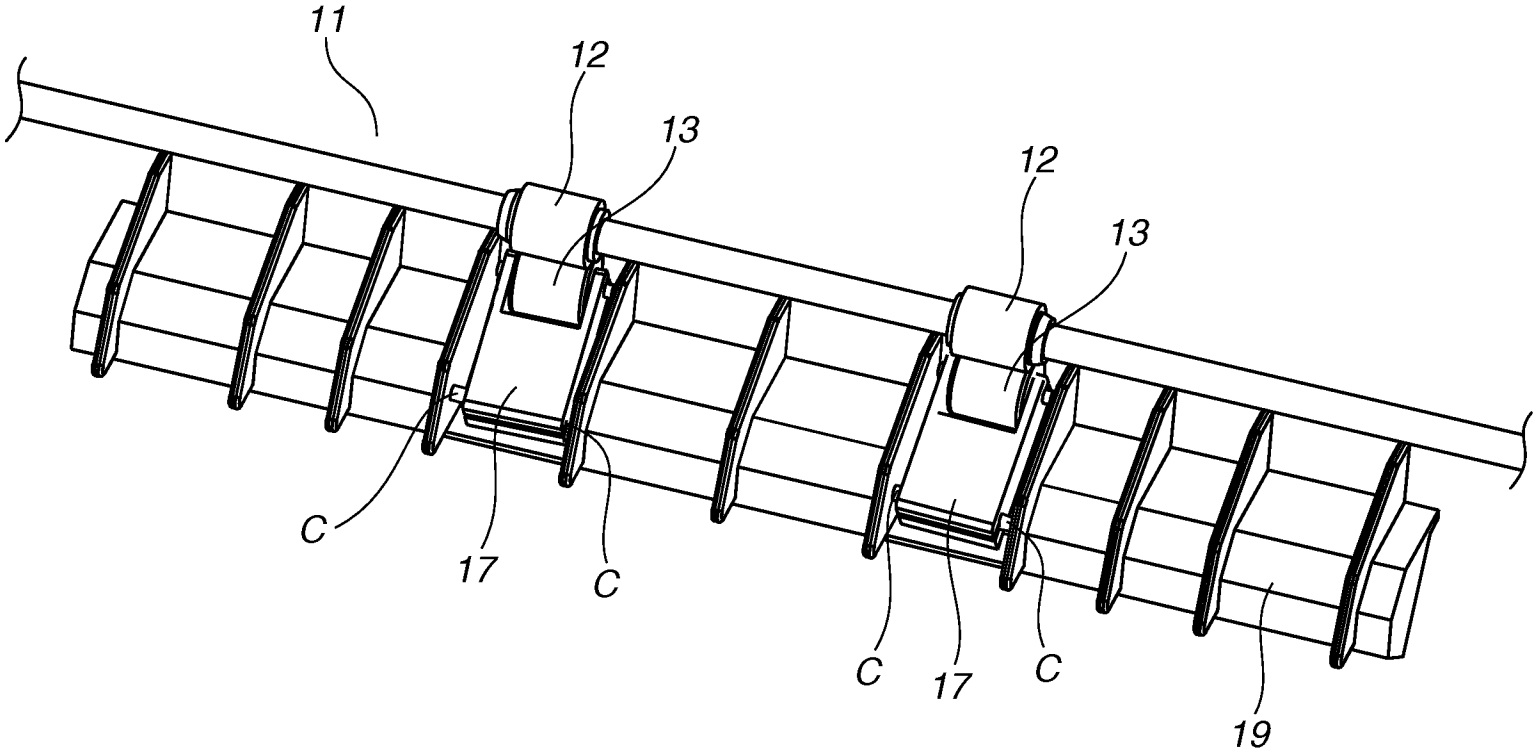
FIG. 2 is a schematic diagram of a discharge unit 11 according to the first exemplary embodiment.
Figure 3:
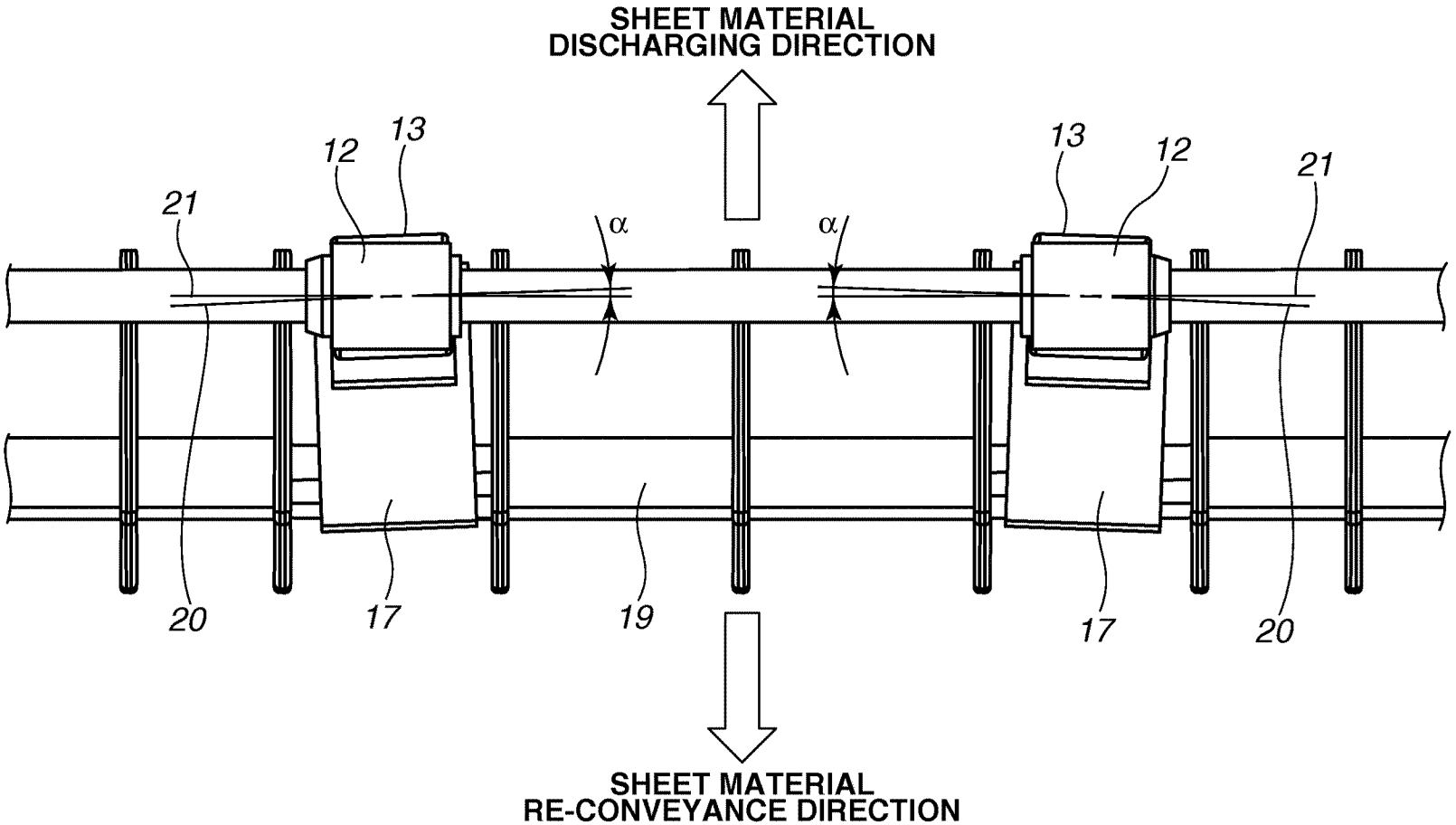
FIG. 3 is a diagram illustrating tilts of rotation shafts of a discharge roller 12 and a discharge roller 13.
Figure 4A:
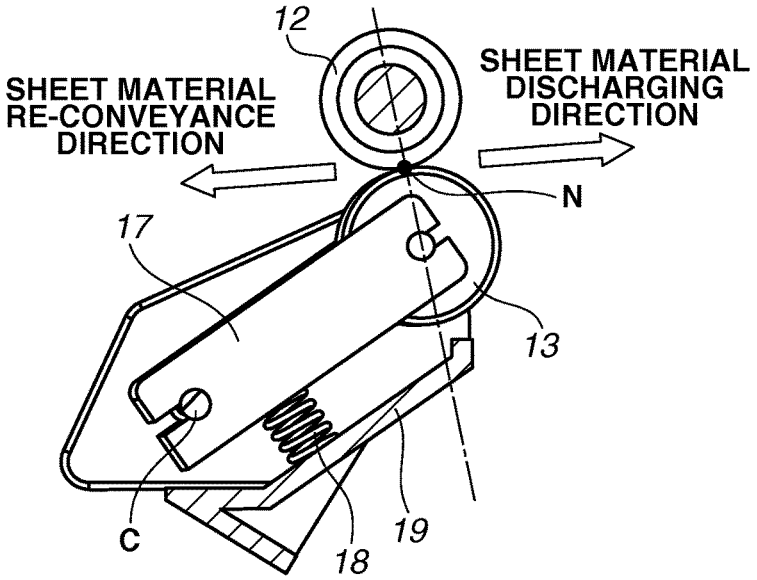
FIG. 4A is a cross section of a discharge roller shaft plane in a case where a sheet material is discharged outside the main body.
Figure 4B:
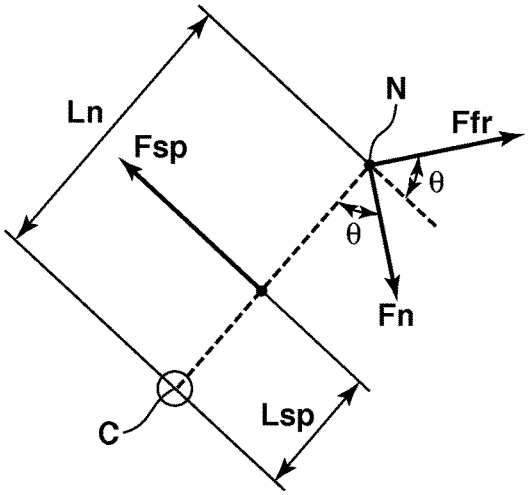
FIG. 4B is a diagram illustrating balance of forces applied to the discharge roller 13 at the nip point when the discharge roller 12 is rotated forward.
Figure 4C:
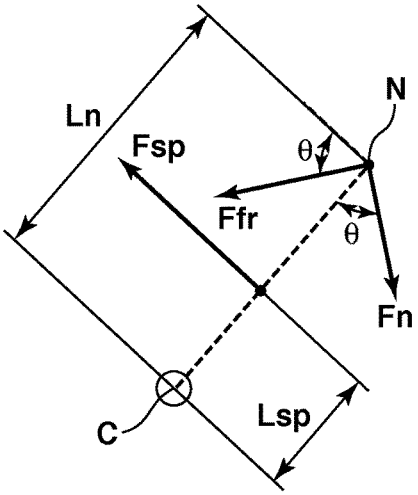
FIG. 4C is a diagram illustrating balance of forces applied to the discharge roller 13 at the nip point when the discharge roller 12 is reversely rotated.

The discharge unit 11 according to the first exemplary embodiment is described below with reference to FIGS. 2 to 4. FIG. 2 is a schematic diagram of the discharge unit 11. FIG. 3 is a diagram illustrating tilts of rotation shafts (driven rotation shafts) of the discharge roller 12 and the discharge roller 13, and is a top view of the discharge unit 11 viewed from the nip direction. FIG. 4A is a cross section of plane of the discharge roller shaft in a case where the sheet material 1 is discharged outside the main body. FIG. 4B is a diagram illustrating balance of forces applied to the discharge roller 13 at the nip point when the discharge roller 12 is rotated forward. FIG. 4C is a diagram illustrating balance of forces applied to the discharge roller 13 at the nip point when the discharge roller 12 is reversely rotated.

As illustrated in FIG. 4A, the discharge roller 12 can be rotated forward or reversely by a driving source (not illustrated). The discharge roller 13 is rotatably held by a discharge roller holding member (holding unit) 17. The discharge roller holding member 17 is subjected to pressure by a pressure member (urging unit) 18 to bring the discharge roller 13 into pressure contact with the discharge roller 12. The discharge roller holding member 17 can be oscillated with respect to a frame 19 with the center of oscillation (fulcrum of oscillation) C as a center. The center of oscillation C is arranged on the upstream side of a straight line made by center of rotation of the discharge roller 12 and center of rotation of the discharge roller 13 in the direction in which the sheet material 1 is discharged. As illustrated in FIG. 3, a rotation shaft 20 supporting the discharge roller 13 is tilted with respect to a rotation shaft 21 of the discharge roller 12 at a tilt angle α.

The nip pressure in a case where the discharge roller 12 is rotated forward to discharge the sheet material 1 outside the main body is described below. FIG. 4B is a schematic diagram illustrating balance of forces applied to a nip point N of the discharge roller 13. The discharge roller 13 is subjected to a force Fsp of the pressure member 18 at a distance Lsp from the center of oscillation C and a force Ffr due to friction with the sheet material 1 at a distance Ln from the center of oscillation C. A nip pressure Fn of the discharge unit 11 can be acquired as follows from balance of moment around the center of oscillation C of the discharge roller holding member 17.

$$Fn \cdot \sin\theta \cdot Ln + Ffr \cdot \cos\theta \cdot Ln = Fsp \cdot Lsp$$

$$Fn = (Fsp \cdot Lsp - Ffr \cdot \cos\theta \cdot Ln)/(Ln \cdot \sin\theta) \quad (1)$$

The discharge rollers 12 and 13 are arranged at a tilt angle α as illustrated in FIG. 3. In a case where the tilt α is zero degrees, friction between the discharge roller 13 and the sheet material 1 is a rolling friction and the friction force is small. In a case where the tilt angle α is three degrees, however, friction between the discharge roller 13 and the sheet material 1 is a sliding friction and the friction force is increased.

For that reason, the nip pressure Fn can be expressed by subtraction of the friction force Ffr from pressure force Fsp as represented by the equation (1), so that the nip pressure in a case where the sheet material 1 is discharged outside the main body by rotating the discharge roller 12 forward can be decreased. This can prohibit the linear trace from being produced due to the discharge roller 13 strongly pressing the sheet material 1.

The nip pressure in a case where the discharge roller 12 is reversely rotated to form images on both sides of the sheet material 1 is described below. As illustrated in FIG. 4C, the discharge roller 13 is subjected to the force Fsp of the pressure member 18 at a distance Lsp from the center of oscillation C and the force Ffr due to friction with the sheet material 1 at a distance Ln from the center of oscillation C, as is the case where the discharge roller 12 is rotated forward. The nip pressure Fn can be acquired as follows from balance of moment around the center of oscillation C of the discharge roller holding member 17.

$$Fn \cdot \sin\theta \cdot Ln = Fsp \cdot Lsp + Ffr \cdot \cos\theta \cdot Ln$$

$$Fn = (Fsp \cdot Lsp + Ffr \cdot \cos\theta \cdot Ln)/(Ln \cdot \sin\theta) \quad (2)$$

Since the force Ffr due to friction between the discharge roller 13 and the sheet material 1 at the time of reversely rotating the discharge roller 12 acts in the opposite direction at the time of rotating forward the discharge roller 12, the friction force Ffr is added to the pressure force Fsp. As is clear from the comparison between the equations (1) and (2), the nip pressure at the time of reversely rotating the discharge roller 12 is becomes larger by 2Ffr·tan θ than that at the time of rotating forward the discharge roller 12.

The nip pressure is high at the time of reverse rotation, so that the linear trace can be produced on the sheet material 1. In the process for forming images on both sides of the sheet material 1, however, the sheet material 1 passes through again the fixing unit 9 for the purpose of fixing the toner image on the sheet material 1, so that heat and pressure are applied to the sheet material 1 to cause the linear trace to disappear. As described above, when the sheet material 1 is discharged outside the main body, the nip pressure is decreased to allow the linear trace to be suppressed even in a case where an image is formed on both sides of the sheet material 1.

As the tilt angle α is larger, the difference between the nip pressures at the time of forward and reversely rotating the discharge roller 12 can be made larger. However, if the tilt angle α is excessively large, the friction between the discharge roller 13 and the sheet material 1 is also made excessively large, which may remove the toner image fixed to the sheet material 1. For this reason, it is desirable that the tilt angle α is approximately 2° to 3° as in the first exemplary embodiment.

As described above, according to the first exemplary embodiment, the nip pressure can be decreased at the time of rotating forward the discharge roller 12 and also increased at the time of reversely rotating the discharge roller 12. Therefore, in a case where the sheet material 1 is discharged outside the main body, the linear trace on the sheet material 1 can be suppressed, and in a case where images are formed on both sides of the sheet material 1, the sheet material 1 can be conveyed even if the sheet material 1 is subjected to the conveyance resistance of the re-conveyance guide 14 and the registration shutter 16. This allows the main body to be downsized and a good image quality to be achieved at a low cost without the nip pressure of roller pairs being decreased by adding the roller pair of the discharge unit 11 and without the main body being increased in size by increasing the curvature of the re-conveyance guide 14 to decrease the resistance of the re-conveyance guide 14.

A second exemplary embodiment is described below with reference to FIGS. 5 to 8. The configuration and operation of the second exemplary embodiment which are common to those of the first exemplary embodiment are properly omitted in description.

Figure 5:
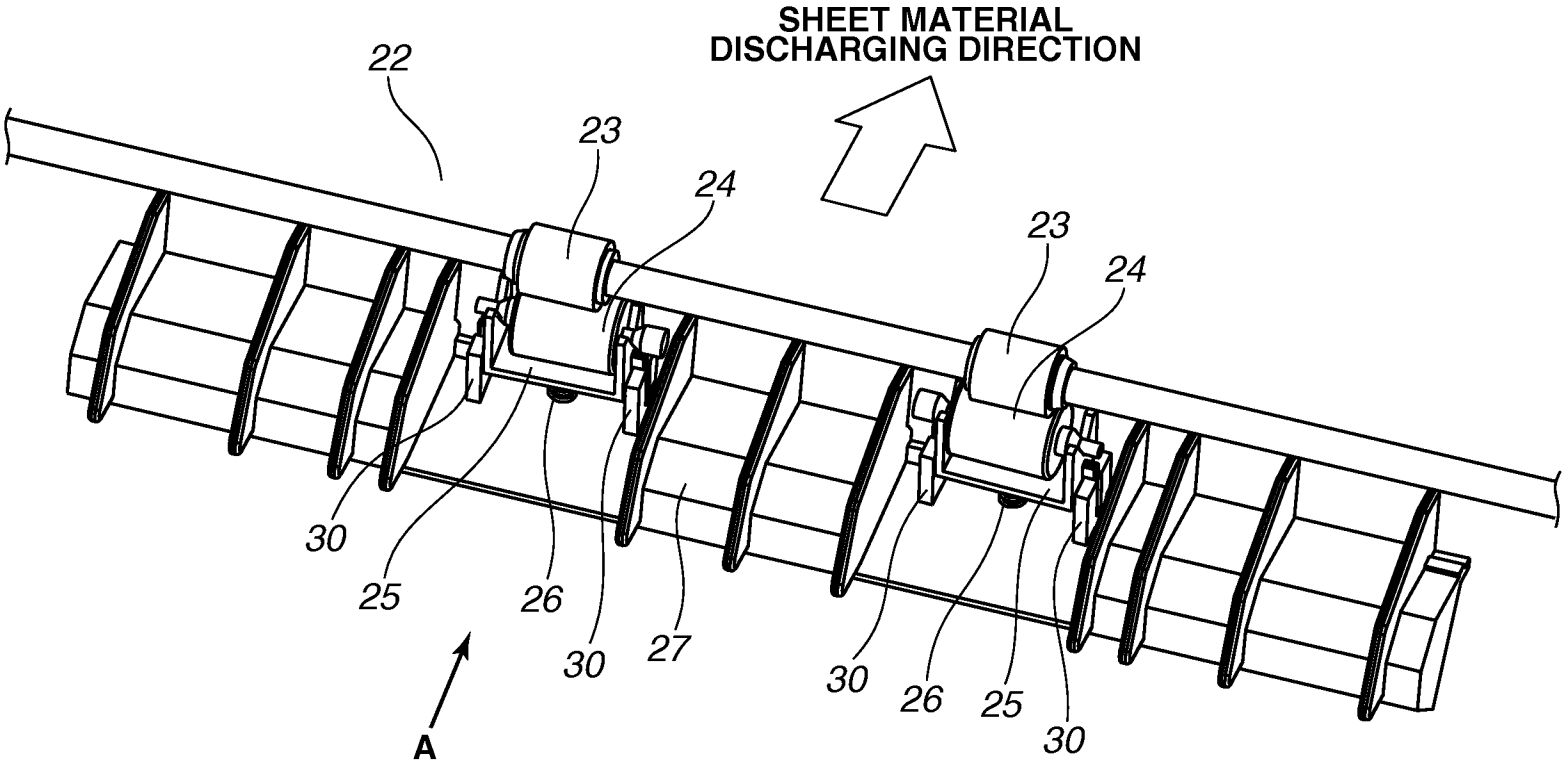
FIG. 5 is a perspective view of a discharge unit 22 according to a second exemplary embodiment.
Figure 6A:
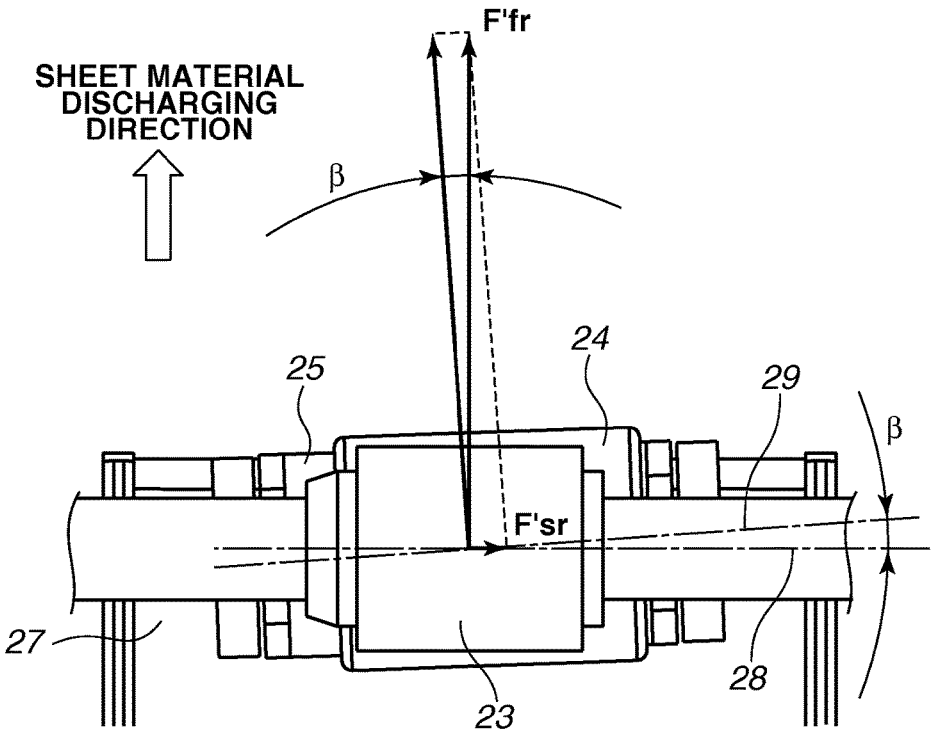
FIG. 6A is a diagram illustrating a friction force applied to a discharge roller 24 at the nip point at the time of rotating forward a discharge roller 23 and tilts of rotation shafts of the discharge rollers 23 and 24.
Figure 6B:
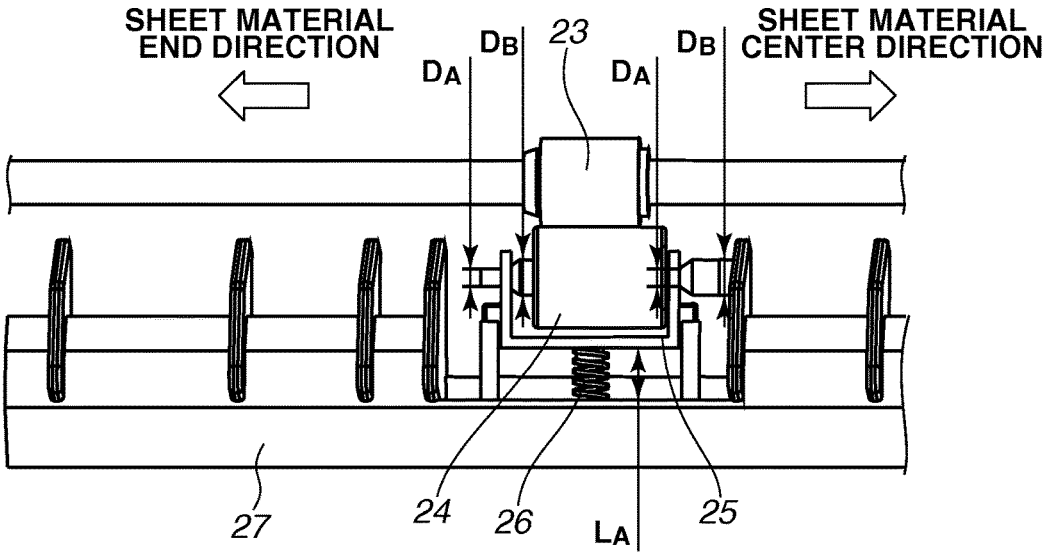
FIG. 6B illustrates a conveyance direction face of the sheet material at the time of rotating forward the discharge roller 23.
Figure 7A:
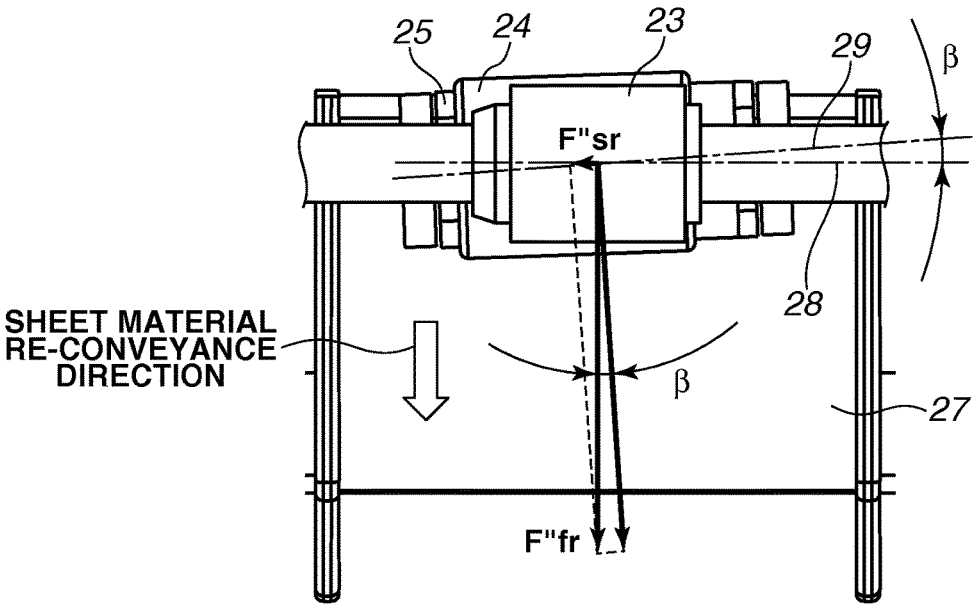
FIG. 7A is a diagram illustrating a friction force applied to the discharge roller 24 at the nip point at the time of reversely rotating the discharge roller 23 and tilts of rotation shafts of the discharge rollers 23 and 24.
Figure 7B:
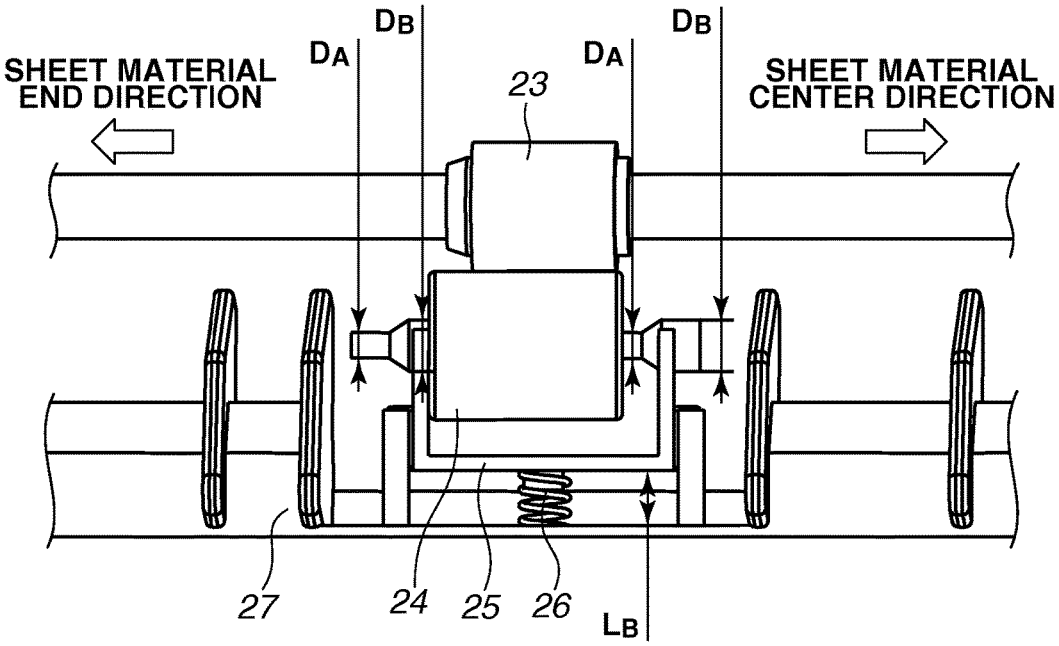
FIG. 7B illustrates a conveyance direction face of the sheet material at the time of reversely rotating the discharge roller 23.
Figure 8A:
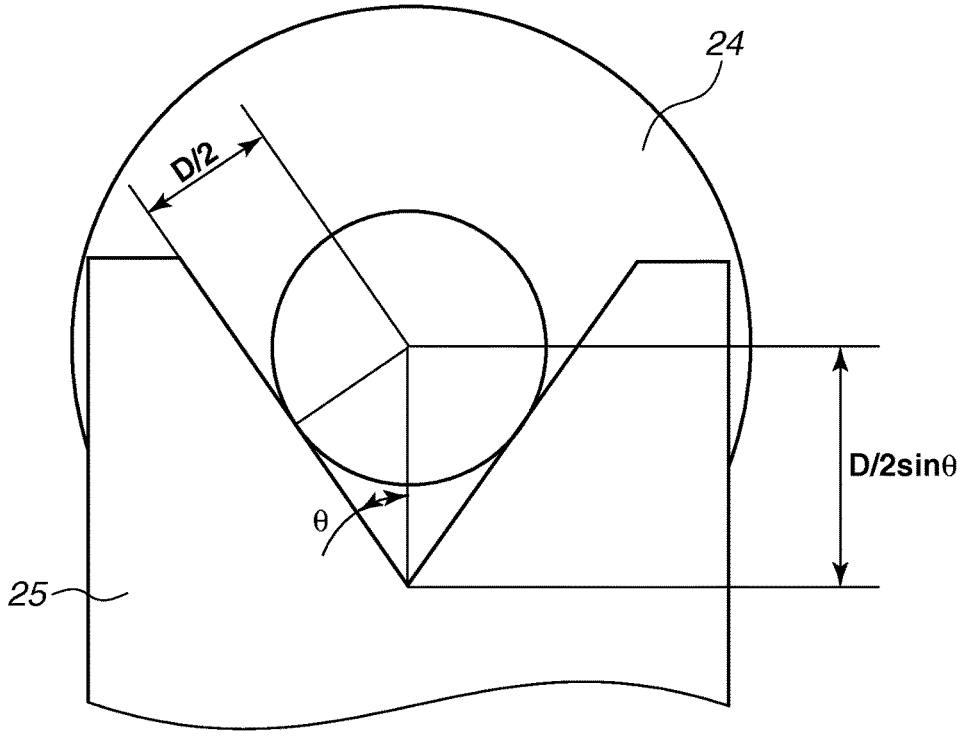
FIG. 8A is an expanded view of the discharge roller 24 and a discharge roller shaft holding unit of a discharge roller holding member.
Figure 8B:
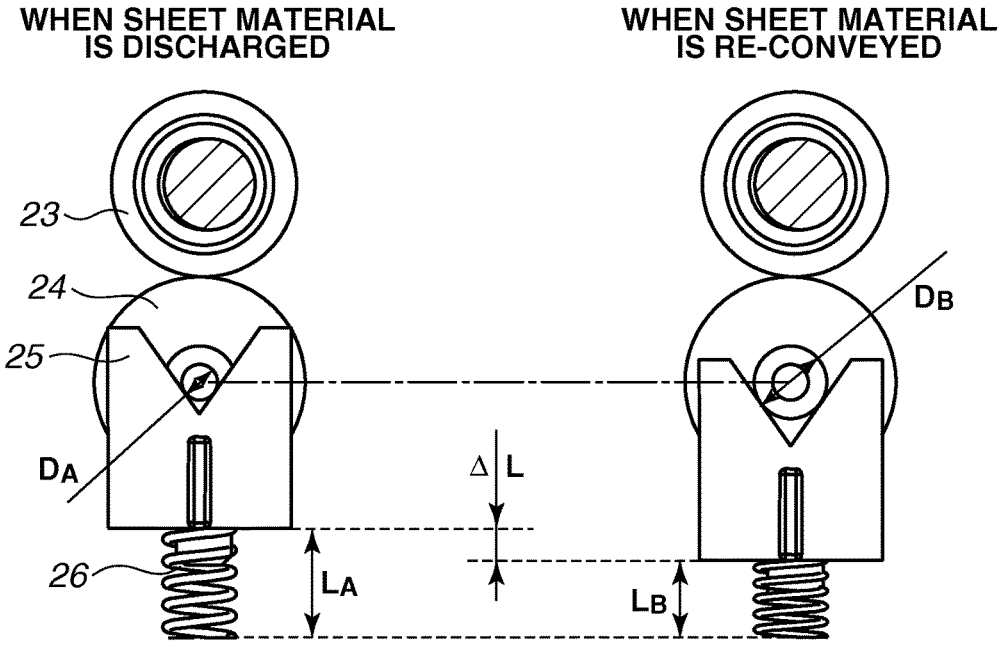
FIG. 8B is a diagram illustrating a change in height of the discharge roller holding member 25 at the time of discharging and re-conveying the sheet material.

FIG. 5 is a perspective view of a discharge unit according to the second exemplary embodiment. FIG. 6B illustrates a conveyance direction face of the sheet material 1 (viewed from a direction indicated by an arrow A in FIG. 5) at the time of forward rotating a discharge roller 23. FIG. 6A is a diagram illustrating a friction force applied to a discharge roller 24 at the nip point at the time of rotating forward the discharge roller 23 and tilts of the rotation shafts of the discharge rollers 23 and 24, and is a top view of a discharge unit 22 viewed from the nip direction. FIG. 7A is a diagram illustrating a friction force applied to the discharge roller 24 at the nip point at the time of reversely rotating the discharge roller 23 and a tilts of the rotation shafts of the discharge rollers 23 and 24, and is a top view of the discharge unit 22 viewed from the nip direction. FIG. 7B illustrates a conveyance direction face of the sheet material 1 (viewed from a direction indicated by an arrow A in FIG. 5) at the time of reversely rotating a discharge roller 23. FIG. 8A is an expanded view of the discharge roller 24 and a discharge roller shaft holding unit of a discharge roller holding member 25. FIG. 8B is a diagram illustrating a change in height of the discharge roller holding member 25 at the time of discharging and re-conveying the sheet material 1.

The second exemplary embodiment is similar to the first exemplary embodiment except for the configuration of the discharge unit 22. As illustrated in FIG. 6B, the rotation shaft of the discharge roller 24 has a portion which is coaxial and different in diameter. DA is small in diameter of the rotation shaft and DB is larger in diameter of the rotation shaft. The discharge roller 24 is provided to be movable in the direction orthogonal to the direction in which the sheet is discharged (hereinafter referred to as the width direction).

The discharge roller holding member 25 holds the rotational shaft 29 of the discharge roller 24 at the right and left portions thereof having a same diameter. As illustrated in FIG. 8A, for example, the discharge roller holding member 25 holds the discharge roller 24 with a V-shaped groove even if the diameters of the rotational shaft 29 of the discharge roller 24 are different (even the diameters DA or DB).

As illustrated in FIG. 5, the discharge roller holding member 25 is pressed by a pressure member 26 to press the discharge roller 24 against the discharge roller 23 along a guide portion 30 of a frame 27 in a direction of a straight line made by the center of the discharge roller and the center of the discharge roller 24. As illustrated in FIG. 6A, a rotational shaft 28 of the discharge roller 23 and a rotational shaft 29 of the discharge roller 24 are arranged at a tilt angle β.

The nip pressure in a case where the discharge roller 23 is rotated forward to discharge the sheet material 1 outside the main body is described below. As illustrated in FIGS. 6A and 6B, since the rotational shaft 28 of the discharge roller 23 and the rotational shaft 29 of the discharge roller 24 are arranged at the tilt angle β, the discharge roller 24 is subjected to a force of $F'sr=F'fr\cdot\sin\beta$ being a component of friction force of F'fr due to friction with the sheet material 1 (or the discharge roller 23).

The discharge roller 24 moves to abut on the discharge roller holding member 25 on the center side in the width direction of the sheet material 1 due to the force of F'sr. Therefore, the discharge roller holding member 25 holds the discharge roller 24 at a portion of the diameter DA. If a natural length of the pressure member 26 is L, the working length is LA, and spring constant is k, the nip pressure is expressed as $F'n=k(LA-L)$.

The nip pressure in a case where the discharge roller 23 is reversely rotated to form images on both sides of the sheet 1 is described below. As illustrated in FIGS. 7A and 7B, since the rotational shaft 28 of the discharge roller 23 and the rotational shaft 29 of the discharge roller 24 are arranged at the tilt angle β, the discharge roller 24 is subjected to a force of $F'sr=F''fr\cdot\sin\beta$ being a component of friction force of F"fr due to friction with the sheet material 1 (or the discharge roller 23). The discharge roller 24 moves to abut on the discharge roller holding member 25 on the edge side in the width direction of the sheet material 1 due to the force of F"sr. This means that the discharge roller holding member holds the discharge roller 24 at a portion of the diameter DB. If a natural length of the pressure member 26 is L, the working length is LB, and spring constant is k, the nip pressure is expressed as $F''n=k(LB-L)$.

As illustrated in FIGS. 8A and 8B, the discharge roller holding member 25 holds the discharge roller 24 with the V-shaped groove having an angle 2θ. Thus, the working length of the pressure member 26 changes by $\Delta L=(DB-DA)/(2\cdot\sin\theta)$ between cases where the discharge roller holding member 25 holds the discharge roller 24 by the rotation shaft with the diameter DA and where the discharge roller holding member 25 holds the discharge roller 24 by the rotation shaft with the diameter DB. If the spring constant of the pressure member 26 is k, the nip pressure changes by $k\Delta L$. Since $DA<DB$, the nip pressure satisfies $FA<FB$.

Consequently, according to the second exemplary embodiment, the nip pressure can be decreased at the time of rotating forward the discharge roller 23 and increased at the time of reversely rotating the discharge roller 23. For this reason, according to the second exemplary embodiment, the main body can be downsized and a good image quality can be achieved at a low cost as is the case with the first exemplary embodiment.

As described above, according to the exemplary embodiments of the present invention, the nip pressure of the discharge roller pair at the time of forward and reversely rotating the discharge roller can be changed. This allows the main body to be downsized and a good image quality to be achieved at a low cost.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-184049 filed Sep. 5, 2013, which is hereby incorporated by reference herein in its entirety.

What is claimed is:

1. An image forming apparatus comprising:

an image forming unit configured to form an image on a sheet;

a driving rotation member configured to rotate forward to discharge the sheet, on which the image forming unit has formed the image, outside a main body of the image forming apparatus, and reversely rotate to convey again the sheet to the image forming unit;

a driven rotation member configured to form a nip, at which the sheet is conveyed, with the driving rotation member, and configured to be driven to rotate by the driving rotation member;

a holding member configured to hold the driven rotation member rotatably, the holding member being configured to oscillate; and a coil spring configured to urge the holding member toward the driving rotation member so that the driven rotation member is pressed to the driving rotation member to form the nip, wherein when viewed in a rotation axis direction of the driving rotation member, a fulcrum of oscillation of the holding member is provided on an upstream of a first virtual line, in a conveyance direction of the sheet at the nip, passing through both a rotation center of the driving rotation member and a rotation center of the driven rotation member, and wherein when viewed in the rotation axis direction of the driving rotation member, an intersection point between a coil axis of the coil spring and the first virtual line is arranged in one, where the rotation center of the driving rotation member is not provided, of two regions divided by a second virtual line passing through both the rotation center of the driven rotation member and the fulcrum of oscillation of the holding member.

2. The image forming apparatus according to claim 1, wherein a force by which the driven rotation member is pressed to the driving rotation member at the time of forwardly rotating forward the driving rotation member is smaller than a force by which the driven rotation member is pressed to the driving rotation member at the time of reversely rotating the driving rotation member.

3. The image forming apparatus according to claim 1, further comprising another driven rotation member in addition to the driven rotation member, wherein a rotation axis of the another driven rotation member tilts in an opposite direction to a direction of the rotation axis of the driven rotation member.

4. The image forming apparatus according to claim 1, wherein the driving rotation member is reversely rotated to convey the sheet to a re-conveyance path so that an image is formed on a second surface of the sheet on a first surface of which an image has been formed.

5. The image forming apparatus according to claim 4, further comprising a skew correction portion provided on the re-conveyance path to correct a skew of the sheet.

6. The image forming apparatus according to claim 1, wherein a rotation member pair including the driving rotation member and the driven rotation member is disposed at further downstream side than a fixing portion in the conveyance direction of the sheet.

7. The image forming apparatus according to claim 1, wherein when the driving rotation member and the driven rotation member are viewed in a direction perpendicular to both the conveyance direction of the sheet and the rotation axis direction of the driving rotation member, the holding member is configured so that a rotation axis of the driven rotation member tilts, with respect to a rotation axis of the driving rotation member, centering a middle portion of the driving rotation member in the rotation axis direction of the driving rotation member.

8. A sheet conveying apparatus comprising:

a driving rotation member configured to rotate forwardly and reversely to convey the sheet;

a driven rotation member configured to form a nip, at which the sheet is conveyed, with the driving rotation member, the driven rotation member being driven to rotate by the driving rotation member;

a holding member configured to hold the driven rotation member rotatably, the holding member being configured to oscillate; and a coil spring configured to urge the holding member toward the driving rotation member so that the driven rotation member is pressed to the driving rotation member to form the nip, wherein when viewed in a rotation axis direction of the driving rotation member, a rotation center of the driving rotation member is provided on a downstream of a third virtual line, in a conveyance direction of the sheet at the nip, which passes through a rotation center of the driven rotation member and which is perpendicular to a second virtual line passing through both the rotation center of the driven rotation member and a fulcrum of oscillation of the holding member, and wherein when viewed in the rotation axis direction of the driving rotation member, an intersection point between a coil axis of the coil spring and a first virtual line is arranged in one, where the rotation center of the driving rotation member is not provided, of two regions divided by the second virtual line, the first virtual line passing through both the rotation center of the driving rotation member and the rotation center of the driven rotation member.

* * * * *